United States Patent [19]

Chastanier

[11] 4,195,819

[45] Apr. 1, 1980

[54] WINCH FOR HANDLING AN ELEVATING DOME SHAPED MEMBER OF A BUILDING HAVING A DEVICE ENABLING THE INSTANTANEOUS UNLOCKING OF THE WINCH

[75] Inventor: Roger A. H. Chastanier, Asnieres, France

[73] Assignee: Claude Le Metais, Sceaux, France; a part interest

[21] Appl. No.: 911,137

[22] Filed: May 31, 1978

[30] Foreign Application Priority Data

Jun. 1, 1977 [FR] France ..... 77 16759
Sep. 28, 1977 [FR] France ..... 77 29196

[51] Int. Cl.[2] ..... B66D 1/00
[52] U.S. Cl. ..... 254/186 R; 49/141
[58] Field of Search ..... 254/186 R, 139, 145, 254/146, 186 HC, 173 R, 175.7; 49/141, 379; 116/5, 101; 73/339, 344, 352; 16/49, 63, 71, 78; 70/465

[56] References Cited

U.S. PATENT DOCUMENTS

| | | | |
|---|---|---|---|
| 1,136,141 | 4/1915 | Kelley | 49/141 |
| 2,029,818 | 2/1936 | Fleming | 49/379 |
| 2,100,782 | 11/1937 | Kellogg | 49/141 |
| 3,461,607 | 8/1969 | Kiyoshi et al. | 49/379 |

*Primary Examiner*—Kenneth W. Noland
*Attorney, Agent, or Firm*—Imirie & Smiley

[57] ABSTRACT

The locking device comprises a rod and cooperates, on the one hand, with a ratchet wheel fixed onto the winch drum and, on the other hand, with a flap comprising a spring and which is maintained in the lowered position by a breaking pane, destruction of said breaking pane freeing the flap which under action of the spring raises the locking device whereby freeing the ratchet wheel and the winch drum of which the cable freely unrolls under action of a motor opening the dome shaped member.

8 Claims, 5 Drawing Figures

F1
5
16.
13a
14
11b
18
13
15
11
F3
11a
10.
F2

WINCH FOR HANDLING AN ELEVATING DOME SHAPED MEMBER OF A BUILDING HAVING A DEVICE ENABLING THE INSTANTANEOUS UNLOCKING OF THE WINCH

BACKGROUND OF THE INVENTION

In a great plurality of buildings for various uses, and more particularly in factories and other premises typically for the industry and trade, the roof of such buildings comprises dome shaped members which are generally transparent or translucent and suitably placed for forming the cover of passages in the roof in order to permit, when these dome shaped members are abruptly open, a very important aeration of the premises and more particularly when said premises become full of smoke for any given reason.

However, in normal use, the dome shaped members are closed and if it is desired to open them, as for example for improving a temporary aeration of the premises, it is then necessary to close said dome shaped members one by one from the roof.

This is particularly embarrassing since, if a storm breakes out or if it begins to rain, the inside of the premises is not protected and in some cases there is the risk that important damages will occur.

SUMMARY OF THE INVENTION

The present invention copes with these disadvantages by creating a handling winch having a safety device enabling an instantaneous unlocking of the winch in such a manner that each dome shaped member can be opened or closed by means of the winch from the inside of the building and such that, when needed, with the winch locking means being freed, the dome shaped member can instantaneously be opened in order to provided safety within the building.

According to the invention, the locking means comprising a rod cooperate, on the one hand, with a ratchet wheel fixed to the winch drum and, on the other hand with a flap comprising a spring and which is maintained in the lowered position by a breaking pane. Destruction of the pane frees the flap which under the action of the spring raises the locking means thereby freeing the ratchet wheel and the winch drum. The cable can then freely unroll under action of a motor means thereby opening the dome shaped member.

Another embodiment of the invention provides a freeing device mounted above a winch for automatically freeing the cable and which is characterised in that a drum, containing a reserve of cable from the handling winch and connected to a dome shaped member to be controlled, is freed and releases the reserve of cable. The drum can be freed either through softening of a meltable material upon an inadmissible increase of temperature, or through an electro-magnet activated by a smoke detector.

Various other features of the present invention are moreover revealed in the following detailed disclosure.

The presently preferred embodiments of the invention are shown as non-limitative examples in the accompanying drawings, wherein:

DETAILED DESCRIPTION OF THE PRESENTLY PREFERRED EMBODIMENTS

Figure 3:
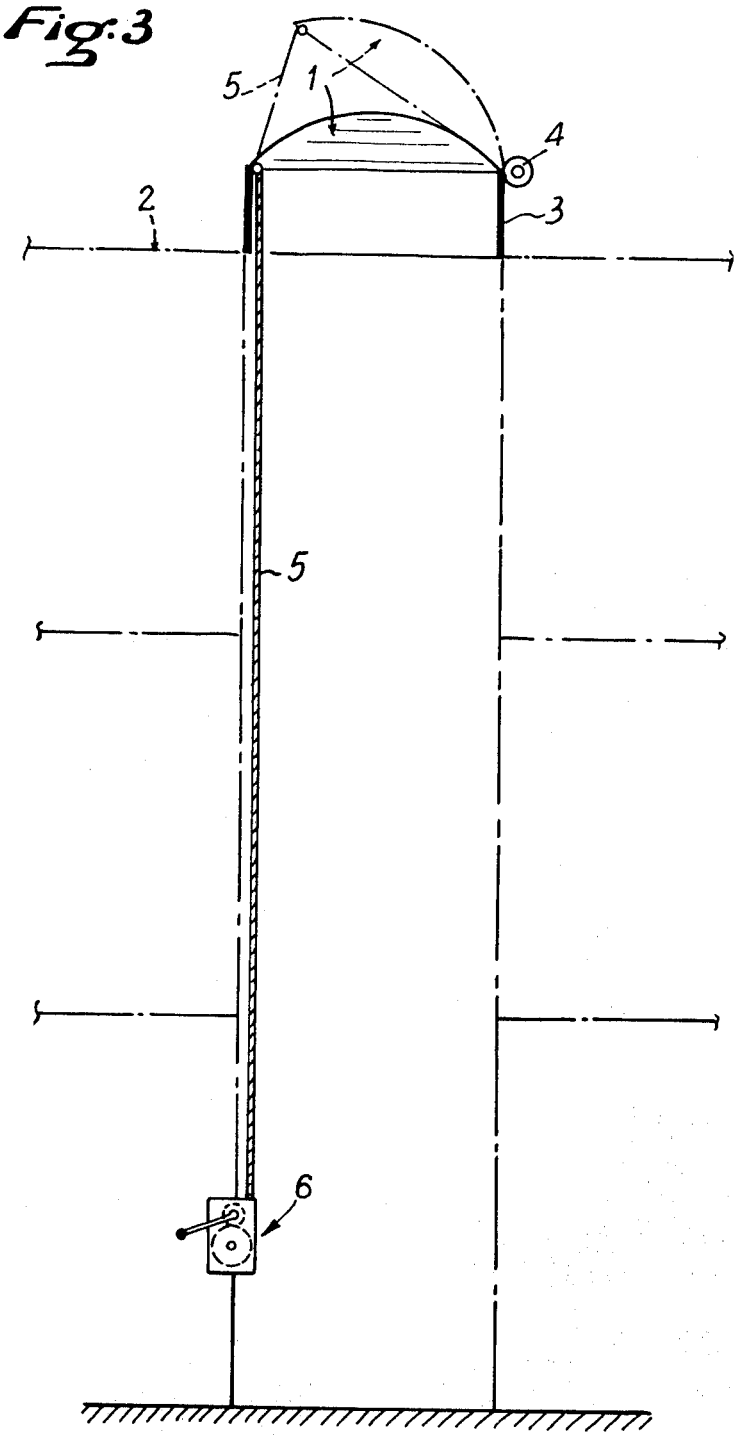
FIG. 3 is a diagrammatic illustration of an arrangement fitted with the winch of the invention and protecting for example a stair-way or a lift-shaft.

Referring now to the drawings, FIG. 3 shows a dome shaped member 1 fitted on the roof 2 of a building and generally mounted on a protruding portion 3. The dome shaped member 1 can be opened under action of motor means 4 which can for example be a stretched spring.

Figure 1:
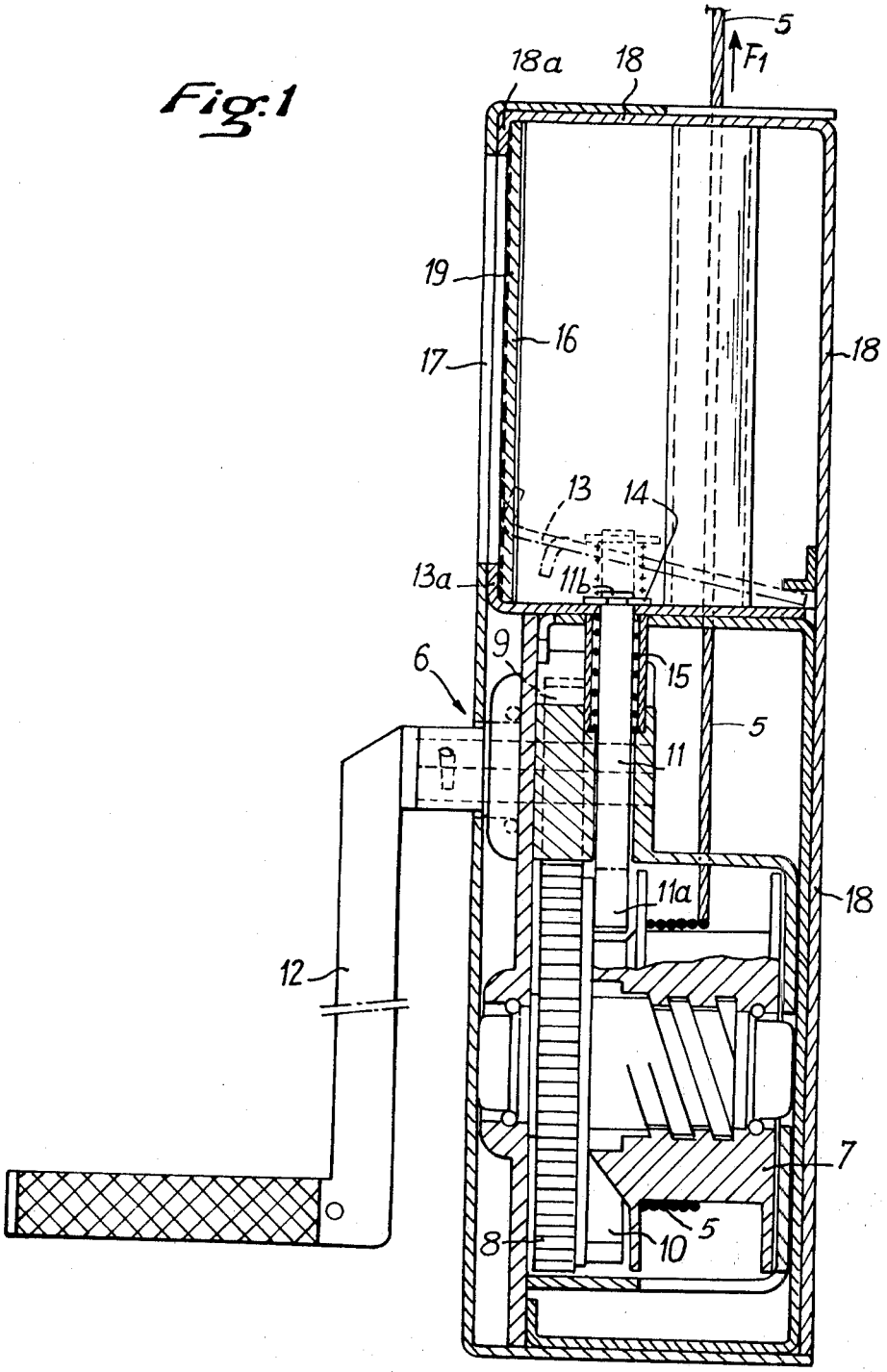
FIG. 1 is a side elevation-view showing in cross-section a winch fitted with a device according to a first embodiment of the invention.
Figure 2:
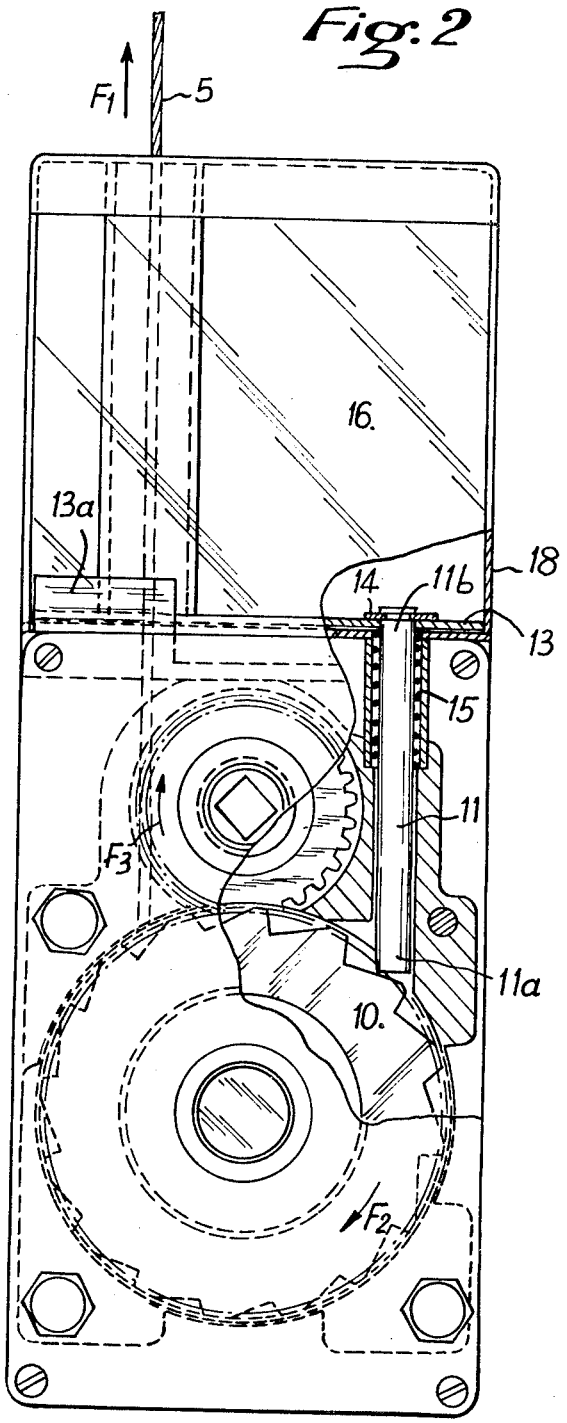
FIG. 2 is a front-view of the device of FIG. 1 without the casing and with various parts cut-away.

In the present case, the end opposite the motor means 4 of the dome shaped member 1 is connected to a cable 5 rolled on a winch 6. Referring also to FIGS. 1 and 2, winch 6 comprises, in a conventional way, a drum 7 rotatively driven from a reducing gear train 8, 9. Moreover, the winch 6 has, between the drum 7 and the driven gear 8, a ratchet wheel 10 the teeth of which cooperate with a locking means 11 in the shape of a rod. The lower end 11*a* of rod 11 acts as a pawl so that it would be easy, by means of a handle 12, to roll the cable 5 in a direction opposite the arrow $F_1$ while also locking the winch, and therefore locking the cable 5 since the lower tapered end 11*a* of the locking means 11 will enter the bottom of one of the teeth of the ratchet wheel 10, in case the drum will have a tendency to rotate in the direction of the arrow $F_2$ (FIG. 2).

The upper end 11*b* of the rod 11 which forms the locking means extends through a flap 13 and has a wide head or flange 14 which rests upon flap 13. The flap 13 is maintained in the lowered position and against the action of a compression spring 15 by a pane 16 which closes a window 17 placed at the front side of a casing 18 enclosing the winch 6. The pane 16 is engaged between the front edge 18*a*of the casing 18 and the upwardly bent edge 13*a* of the flap 13.

Between the handle 12 and the reducing gear mechanism there is provided a device of the clutch type which prevents the handle 12 to be rotatively driven upon the quick unrolling of the cable.

The device of the invention operates as follows:

When there is a need for closing the dome shaped member 1, the handle 12 is rotated in the direction of the arrow $F_3$ (FIG. 2), and the cable 5 rolls in the direction of the arrow $F_2$ around the drum 7 and winch 6, having for its effect to lower the dome shaped member 1 and to stretch the spring 4 constituting the motor means. The lower end 11*a* of the locking means 11, because its own weight, enters in the intervals between the teeth of the ratchet wheel 10, preventing the rotation thereof in the opposite direction. If it is desired to more or less open the dome shaped member 1, the cable 5 is unrolled by means of the handle 12, the motor means 4 then enabling the dome shaped member 1 to open.

In the case of an accident it suffices to breake the pane 16, which is coated with an adhesive film 19 in order to prevent emission of fragments. Upon the breaking of pane 16, flap 13 and consequently also the locking means 11 are raised by the force of the compression spring 15, which results in freeing the teeth of the ratchet wheel 10 fixed onto the drum 7, and thereby permitting cable 5 to unroll freely under the pull applied thereon by the motor means 4 while and thus enabling an abrupt opening of the dome shaped member 1.

Figure 4:
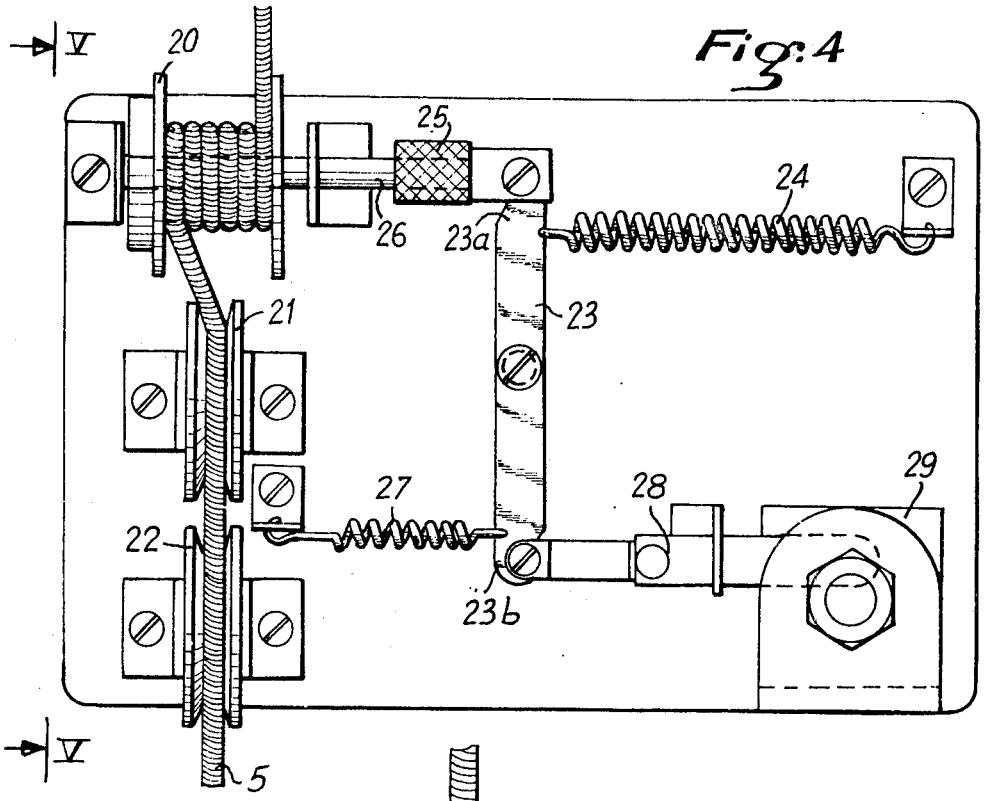
FIG. 4 is a front-view of the device according to another feature of the invention.
Figure 5:
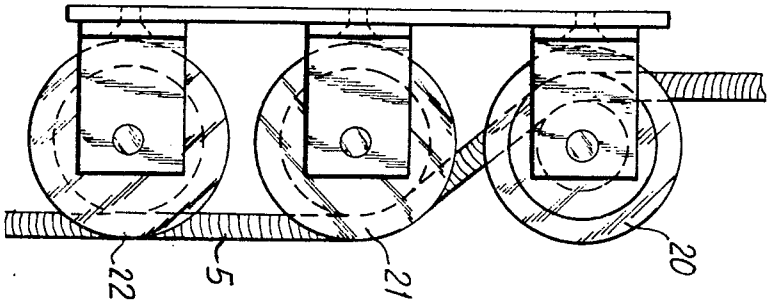
FIG. 5 is a side-view taken along lines V—V of FIG. 4.

In the variant of the invention shown in FIG. 4, an automatic cable freeing device is provided above the winch 6, and this device is constituted by a drum 20 around which is rolled a certain length of the cable 5 which is guided by two superimposed pulleys 21, 22 from the handling winch (not shown). The device comprises a balance bar 23 of which one of the ends 23*a* is subjected to the elastic force of a spring 24 and is connected by means of thermomeltable material part 25 to the shaft 26 of the drum 20, while the other end 23*b* of balance bar 23 which is also subjected to the elastic force of a spring 27 is articulated on a plunger core 28 of an electro-magnet 29 activated by a current from a smoke detector (not shown).

The device according to this variant of the invention operates as follows:

After having unrolled with the handling winch a length of cable sufficient for opening the dome shaped member connected to the end of the cable, the cable 5 is placed in the automatic freeing device by being passed on the guiding pulleys 21, 22 and the cable reserve is rolled onto the drum 20. The cable can then be automatically freed either as a result of an inadmissible increase of the temperature in the premises to be protected or as a result of an emission of smoke above a predeterminated threshold. In the first case, the increase of the temperature makes the thermomeltable material part 25 connecting the shaft 26 to the end 23*a* of the balance bar 23 to melt, which has for its effect to uncouple the shaft 26 and therefore also the drum 20 which, while rotating, frees the cable reserve. In the second case, a smoke detector is activated upon an inadmissible emission of smoke and activates the electromagnet 29 of which the plunger core 28 pushes the balance bar 23 which pivots under action of the springs 24, 27 in order to cause the uncoupling of the shaft 26 from the drum 20, which results in freeing the cable reserve.

The invention is not restricted to the embodiments shown and described in detail since various modifications thereof can be applied thereto without departing from the scope of the invention as shown in the appended claims.

We claim:

1. Winch for handling an openable vent member of a building, the vent member being openable under action of a motor means and being held shut by a cable attached thereto at one end thereof; said winch comprising:

a winch drum for having the other end of the cable wound thereon;

locking means for locking the winch comprising a rod having a reduced section or pawl at one end and a flange section at the other end;

means for selectively operating said winch drum;

a ratchet wheel fixed onto the winch drum and mounted for cooperation and engagement with said rod pawl;

a flap having an orifice through which said rod extends and said rod flange engaging said flap, said flap being positionable between a normal first position in which said rod pawl can engage said ratchet wheel and a second position in which said rod pawl is out of engagement with said ratchet wheel;

a spring means bearing on said flap for resiliently urging said flap out of said first position to said second position and hence for urging said rod pawl out of engagement with said ratchet wheel; and a breaking pane which engages said flap and maintains said flap in said first position against said spring means such that destruction of said breaking pane frees said flap which under action of said spring is moved out of said first position and which moves said blocking means, thereby freeing said ratchet wheel and hence said winch drum and thereby permitting the cable to unroll as the motor means opens the vent member.

2. Winch according to claim 1, wherein the unlocking device is contained in a casing comprising a front face with a window which is closed by the breaking pane, destruction of said breaking pane controlling the instantaneous unlocking of the winch.

3. Winch for handling an elevating vent member of a building comprising a drum for the winch, locking means for locking the winch and an unlocking device for instantaneously unlocking the winch, wherein the locking means comprises a rod and cooperates, on the one hand, with a ratchet wheel fixed onto the winch drum and, on the other hand, with a flap and a spring engaged therewith and which is maintained in the lowered position by a breaking pane, destruction of said breaking pane freeing said flap which under action of said spring raises the locking means thereby freeing the ratchet wheel and the winch drum which permits cable to freely unroll under action of a motor means opening the vent member, a reserve of cable rolled on a further drum and coming from the winch, and means to automatically free said reserve of cable following a heat effect or a smoke emission.

4. Winch according to claim 3 wherein the reserve of cable coming from the handling winch is connected to a vent member to be controlled, said further drum being freed to release the reserve of cable through softening of a meltable material upon an inadmissible increase of temperature.

5. Winch according to claim 3 wherein the reserve of cable coming from the handling winch is connected to a vent member to be controlled, said further drum being freed to release the reserve of cable through an electromagnet activated by a smoke detector.

6. Winch according to claim 3, wherein said freeing means comprises a balance bar having one end which is subjected to tensile force from a first elastic means and is connected to a shaft of the further drum by means of a thermo-meltable material part, said balance bar having an other end which is also subjected to tensile force from a second elastic means and is articulated on a plunger core of an electro-magnet.

7. Winch according to claim 3 wherein said freeing means comprises a meltable material means, the softening of which at a predetermined temperature frees said further drum thereby releasing said reserve of cable.

8. Winch according to claim 7 wherein said freeing means further comprises an electro-magnet means activated by a smoke detector and connected to said further drum such that said further drum is freed upon activation of said electro-magnet means.

* * * * *